US011634309B2

(12) United States Patent
Miller

(10) Patent No.: US 11,634,309 B2
(45) Date of Patent: Apr. 25, 2023

(54) MULTI-TOOL CONTAINER OPENING DEVICE

(71) Applicant: Darrell Miller, St. Paul, MN (US)

(72) Inventor: Darrell Miller, St. Paul, MN (US)

( * ) Notice: Subject to any disclaimer, the term of this patent is extended or adjusted under 35 U.S.C. 154(b) by 745 days.

(21) Appl. No.: 16/485,165

(22) PCT Filed: Feb. 9, 2018

(86) PCT No.: PCT/US2018/017714
§ 371 (c)(1),
(2) Date: Aug. 11, 2019

(87) PCT Pub. No.: WO2018/148608
PCT Pub. Date: Aug. 16, 2018

(65) Prior Publication Data

US 2020/0039806 A1 Feb. 6, 2020

Related U.S. Application Data

(60) Provisional application No. 62/457,796, filed on Feb. 10, 2017.

(51) Int. Cl.
*B67B 7/44* (2006.01)
*B67B 7/16* (2006.01)
(Continued)

(52) U.S. Cl.
CPC ..... *B67B 7/44* (2013.01); *B67B 7/16* (2013.01); *B67B 7/18* (2013.01); *B67B 7/40* (2013.01);
(Continued)

(58) Field of Classification Search
CPC .... B67B 7/16; B67B 7/18; B67B 7/40; B67B 7/44; B67B 2007/166; B67B 2007/188
See application file for complete search history.

(56) References Cited

U.S. PATENT DOCUMENTS

D215,807 S * 11/1969 Weingardt ..... D8/40
4,667,544 A * 5/1987 Milo ..... B67B 7/44 81/3.55
(Continued)

FOREIGN PATENT DOCUMENTS

EP 1172328 A1 * 1/2002 ..... B67B 7/16
WO WO-2005051836 A1 * 6/2005 ..... B67B 7/16
(Continued)

OTHER PUBLICATIONS

"Twistease Jar, Can, and Bottle Opener, Great for Those with Arthritis" (HANDY GOURMET) May 2, 2016; retrieved from internet Apr. 19, 2018; <URL=https://www.amazon.com/Twistease-Bottle-Opener-Great-Arthritis/dp/BOOT6PVLEE>, 8 pages.
(Continued)

*Primary Examiner* — David B. Thomas
(74) *Attorney, Agent, or Firm* — Skaar Ulbrich Macari, P.A.

(57) ABSTRACT

A container opening device is provided. The device can comprise a plurality of opening structures, including at least a pry portion, a twist-off portion, and a finger receiving portion. A gripping portion can also be included. These structures and elements define a multi-tool device configured to open various types of containers, such as beverage bottles having a pop-off cap, beverage bottles having a twist-off cap, and beverage cans having an opening tab (e.g., pull tab).

20 Claims, 8 Drawing Sheets

(51) Int. Cl.
*B67B 7/18* (2006.01)
*B67B 7/40* (2006.01)

(52) U.S. Cl.
CPC ... *B67B 2007/166* (2013.01); *B67B 2007/188* (2013.01)

(56) References Cited

U.S. PATENT DOCUMENTS

| | | | | |
|---|---|---|---|---|
| 4,846,024 | A | 7/1989 | Bryant et al. | |
| 6,098,497 | A | 8/2000 | Larose | |
| D438,075 | S * | 2/2001 | Van Meter | D8/40 |
| D509,456 | S * | 9/2005 | Ricci | D8/40 |
| D523,711 | S * | 6/2006 | Ryan | D8/40 |
| 7,143,666 | B1 * | 12/2006 | Gutierrez | B67B 7/16 D8/40 |
| 7,827,884 | B2 * | 11/2010 | Lawson | B67B 7/403 81/3.09 |
| D635,422 | S * | 4/2011 | Wegener | D8/34 |
| 7,966,910 | B1 * | 6/2011 | Cece | B67B 7/16 D8/40 |
| D652,275 | S * | 1/2012 | Wegener | D8/34 |
| 9,114,968 | B2 * | 8/2015 | Manger | B67B 7/403 |
| 10,081,528 | B2 * | 9/2018 | Romero | B67B 7/403 |
| D832,126 | S * | 10/2018 | Carlstrom | D11/2 |
| 2002/0189406 | A1 * | 12/2002 | Hahn | B67B 7/16 81/3.55 |
| 2003/0159545 | A1 * | 8/2003 | Teppe | B67B 7/16 81/3.55 |
| 2005/0035080 | A1 * | 2/2005 | Romero | B67B 7/403 215/304 |
| 2005/0076742 | A1 * | 4/2005 | Yurek, Jr. | B67B 7/24 81/3.55 |
| 2010/0212458 | A1 * | 8/2010 | Wegener | B67B 7/16 81/3.55 |
| 2010/0288080 | A1 * | 11/2010 | Babusiaux | B67B 7/16 81/3.4 |
| 2012/0103015 | A1 | 5/2012 | Graham et al. | |
| 2016/0264389 | A1 | 9/2016 | Guterman | |

FOREIGN PATENT DOCUMENTS

| | | | | |
|---|---|---|---|---|
| WO | WO-2009001091 | A1 * | 12/2008 | B67B 7/16 |
| WO | 2011065984 | A1 | 6/2011 | |

OTHER PUBLICATIONS

"Zliss Four-In-One Opener" (ABLEDATA) Dec. 12, 2011; retrieved from internet Apr. 18, 2018; <URL=https://abledata.acl.gov/product/zyliss-four-one-opener>, 4 pages.

The International Search Report and Written Opinion rendered by the International Searching Authority for PCT/US18/17714, dated May 17, 2018, 10 pages.

* cited by examiner

MULTI-TOOL CONTAINER OPENING DEVICE

PRIORITY

This Application claims priority to and the benefit of U.S. Provisional Patent Application No. 62/457,796, filed Feb. 10, 2017, which is incorporated fully herein by reference.

FIELD

The present invention relates generally to tools and, more particularly, to multi-tool devices and methods for opening containers, such as beverage bottles, cans, and the like.

BACKGROUND

While there are bottle and can opening devices available on the market, they are limited in use and convenience. Namely, many are bulky, adapted for attachment to key-chains, or simply limited in what types of beverage containers they are configured to open. These conventional devices also lack specially designed features and structures to facilitate portability and ease-of-use.

As a result, there is a need for a new and improved opening device that solves the innate functional and design flaws of these conventional devices.

SUMMARY

Embodiments of the present invention include a device having a plurality of features adapted to open a variety of different containers, such as beverage cans and bottles. The device can include a pry portion, a twist-off portion, and a gripping portion. These structures and elements define a multi-tool device configured to open various types of containers, such as beverage bottles having a pop-off cap, beverage bottles having a twist-off cap, and beverage cans having an opening tab (e.g., pull tab). The present invention provides a highly functional and convenient device for home use, use by bartenders, and the like.

The pry portion can include a first extending member and a second extending member. In addition, the first member can include a protrusion and a sharp beveled or chamfered edge. The first member can be used to open or pull up a tab on beverage cans. Similarly, the first and second members are used in combination to grasp and then remove a cap from a beverage bottle.

The twist-off portion can include a recess or cavity, and can include a plurality of interior extending protrusions or teeth adapted to corresponding engage and selectively lock with the peripheral grooves/teeth of a bottle cap. The cavity can further include a release tab.

The finger receiving portion can include an outer, generally circular, aperture, and an adjustable ring. The ring can include opposing prongs to define a selectively expandable boundary for the users' finger. As such, users (such as bartenders) can carry the device on their finger, with the device conveniently resting in their palm, for quick availability and use.

The above summary is not intended to describe each illustrated embodiment, claimed embodiment or implementation of the invention. The detailed technology and preferred embodiments implemented for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

BRIEF DESCRIPTION OF THE DRAWINGS

The invention may be more completely understood in consideration of the following detailed description of various embodiments of the invention in connection with the accompanying drawings, in which.

Figure 1:
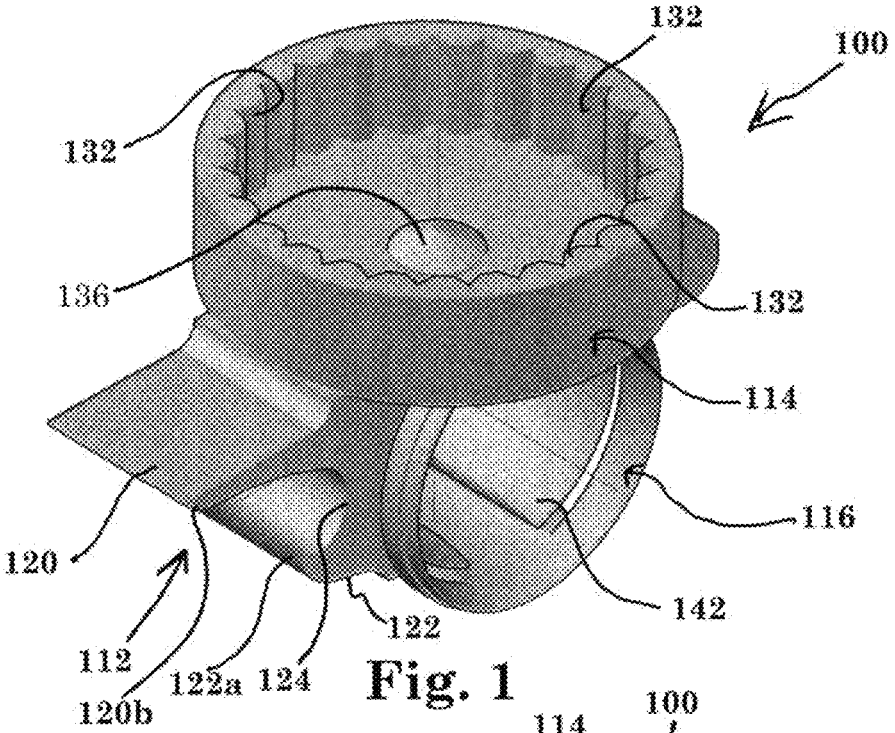
FIGS. 1-7 show various views of a container opening device, in accordance with embodiments of the present invention.
Figure 2:
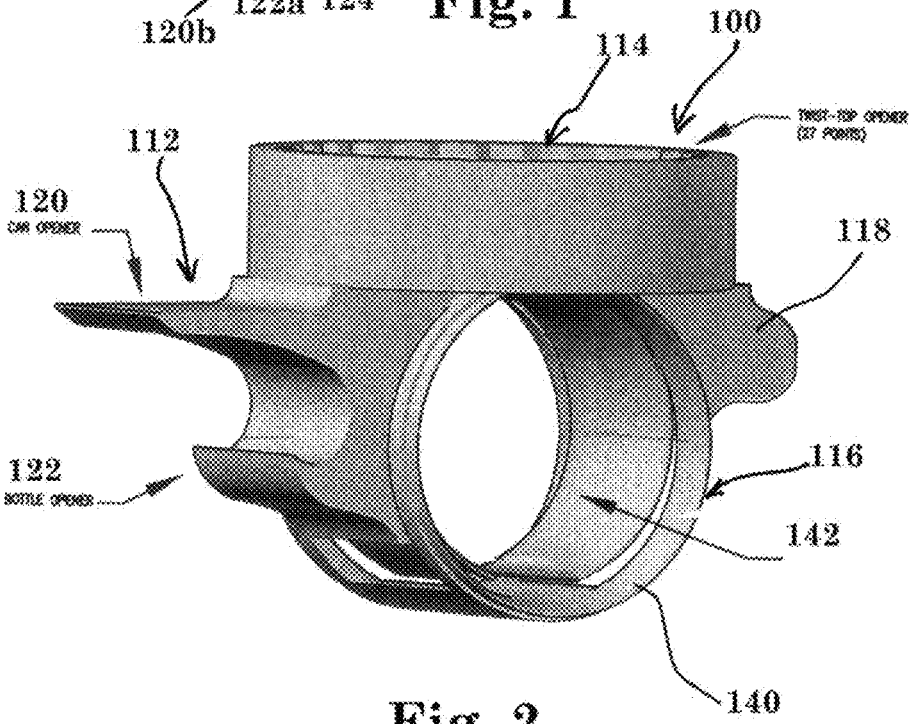
Figure 3:
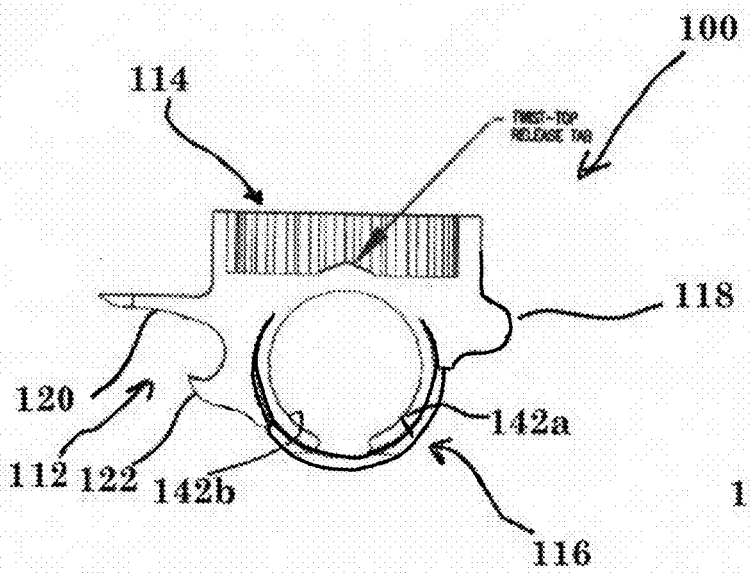
Figure 4:
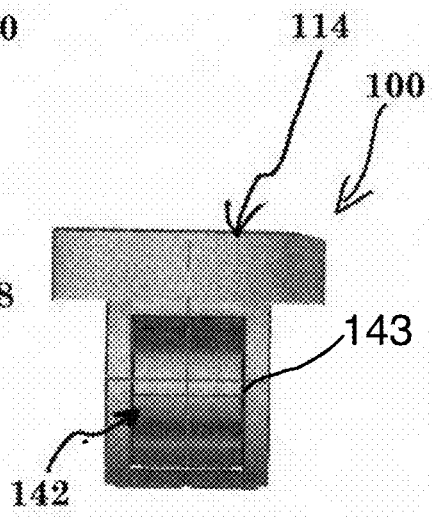
Figure 5:
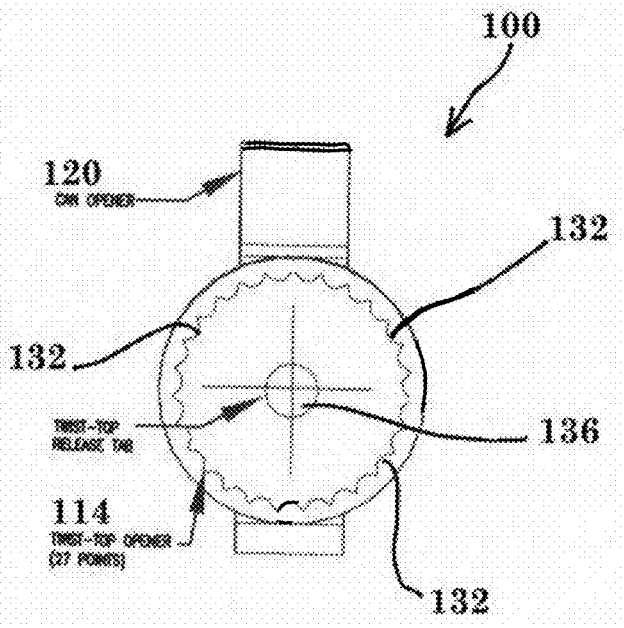
Figure 6:
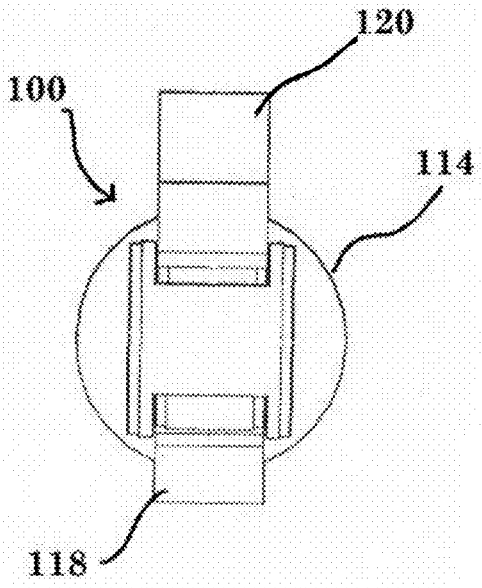
Figures 7, 8, 9, 10:
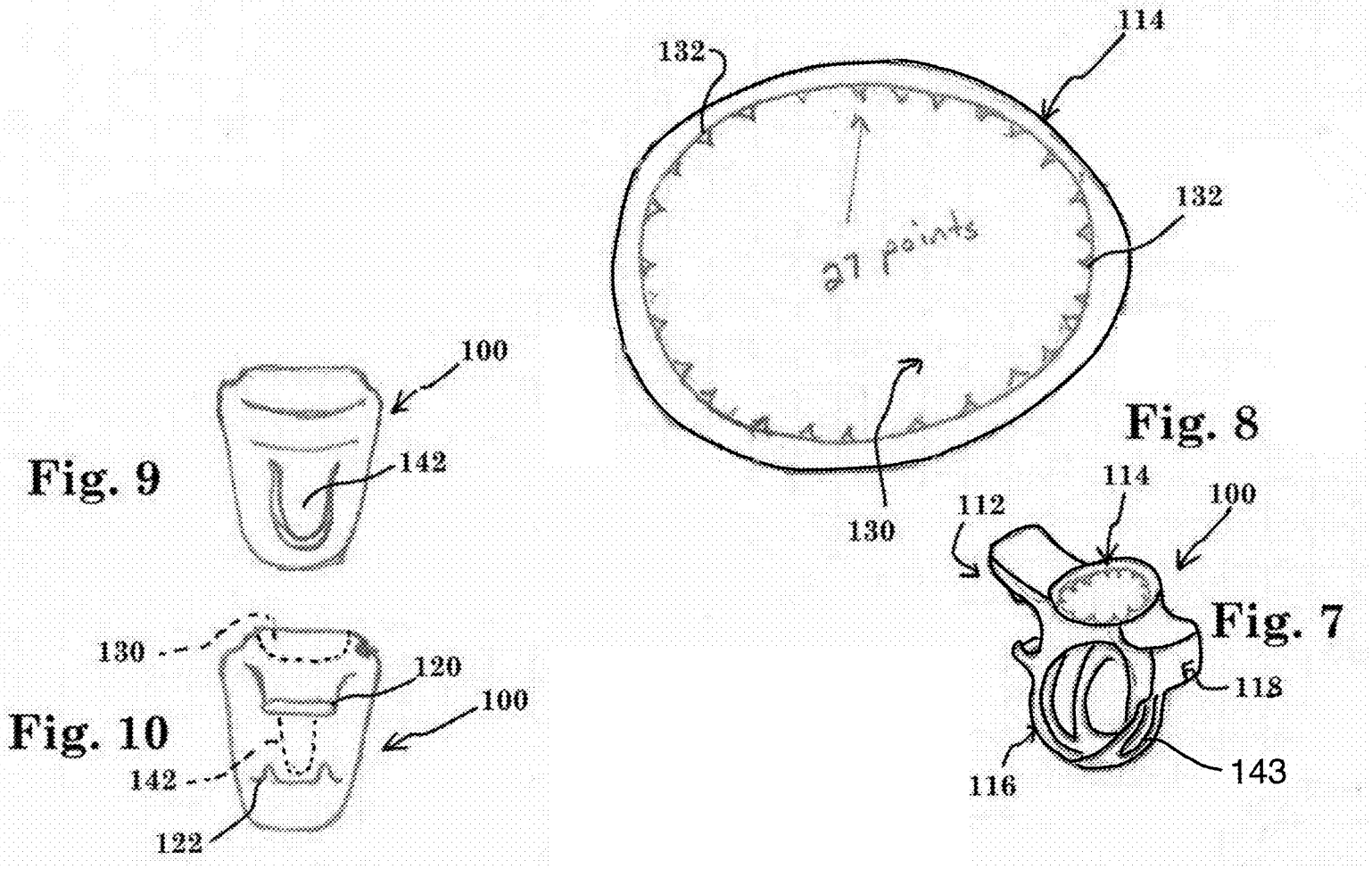
FIG. 8 shows a partial view of a recess and teeth of a container opening device, in accordance with embodiments of the present invention.
FIGS. 9-10 show side view of a container opening device, in accordance with embodiments of the present invention.
Figures 11, 12:
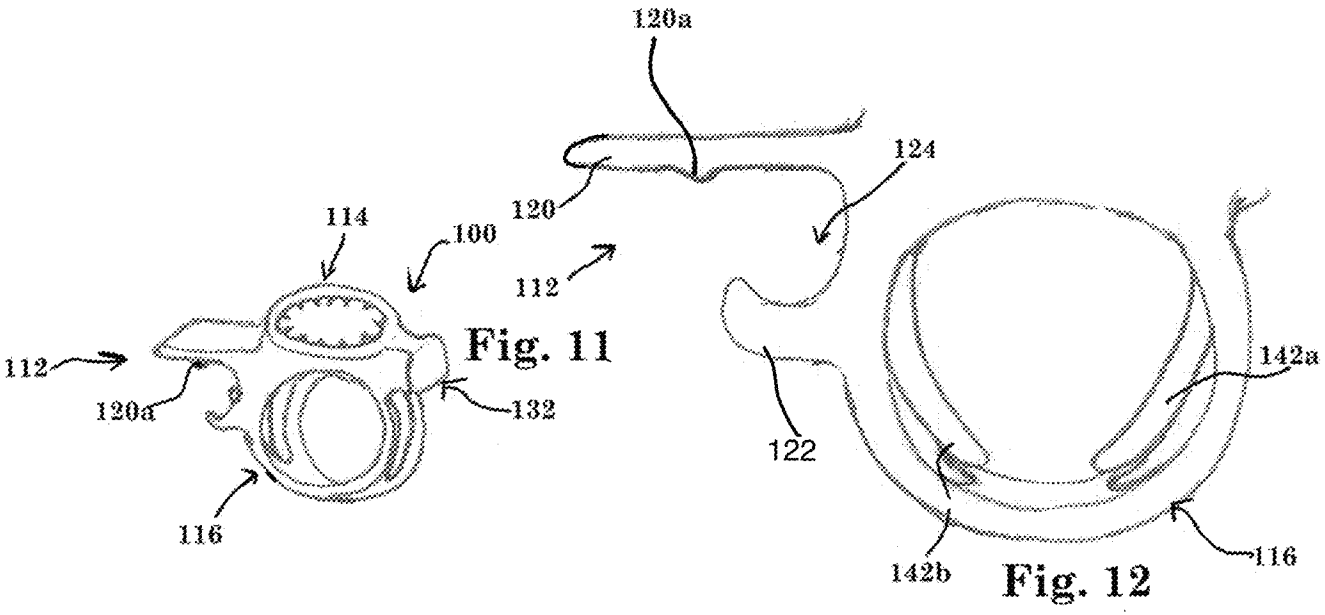
FIG. 11 shows a perspective view of a container opening device, in accordance with embodiments of the present invention.
FIG. 12 shows partial view of the ring and pry portions of a container opening device, in accordance with embodiments of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the invention is to cover all modifications, equivalents, and alternatives falling within the spirit and scope of the invention as defined by the appended claims.

DETAILED DESCRIPTION

Referring generally to FIGS. 1-18, a container opening device 100 is disclosed. The device 100 can comprise a plurality of opening structures, including at least a pry portion 112 and a twist-off portion 114. The device 100 can also include a finger receiving portion 116, and a gripping portion 118. These structures and elements define a multi-tool device configured to open various types of containers, such as beverage bottles B1 having a pop-off cap, beverage bottles B2 having a twist-off cap, and beverage cans C having an opening tab (e.g., pull tab). The present invention provides a highly functional, convenient, and easy to use device for home use, for bartenders and service uses, and the like. The device 100 can include other opening structures and can be used to open other types of beverage containers and corresponding opening tabs, caps, surfaces, structures, and devices without deviating from the spirit and scope of the present invention.

Again, embodiments of the device 100 include functionally distinct portions, including a pry portion 112, a twist-off portion 114, and a finger receiving portion 116, as detailed in FIGS. 1-12. The pry portion 112 can include a first extending member 120 and a second extending member 122, extending out laterally from the device 100. In certain embodiments, the first member 120 can extend out a distance farther than and above the second member 122 (e.g., ¾ inch from the twist-off portion 114). In addition, the first member 120 can include a protrusion 120*a* and a sharp beveled or chamfered edge 120*b*. The second member 122 can include an upwardly extending arcuate portion 122*a*. The combination of the members 120, 122 define an elongate and generally C-shaped receiving cavity 124. As disclosed herein, the first member 120 can be used to open or pull up a tab or like member 160 on beverage containers C. Similarly, the first and second members 120, 122 are used in tandem to grasp and then remove a cap 162 from a beverage container B1.

The twist-off portion 114 can be generally circular in cross-section and can include an interior cavity or recess 130. The recess 130 can have a diameter of approximately 1 inch in certain embodiments and is adapted to receive at least the cap 164 of a container bottle B2. The recess 130 can include a plurality of extending protrusions or teeth 132 adapted to corresponding engage and selectively lock with the peripheral grooves/teeth of the cap 164. In various embodiments, there can be twenty-seven teeth 132 within the cavity 130. Other dimensional constructs and configurations for the portion 114, and the corresponding cavity 130 and teeth 132, are also envisioned for the present invention. The cavity 130 can further include a release tab 136.

The finger receiving portion 116 can include an outer, generally circular, aperture 140. The aperture 140 can include an adjustable ring 142. The ring 142 can be defined by opposing prongs 142*a*, 142*b* and can be constructed of a separate material, or of a portion of the aperture wall 140, to define a selectively expandable boundary for the user's finger. An opening 143 can be defined in the wall of the ring 142 as well. The ring 142 can be constructed and formed with shape memory, spring, or rebounding characteristics such that it can automatically expand and retract relative to the level of force from the insertion and removal of the user's finger—providing a one-size-fits-all construct. The ring material can be plastic, metal, or the like.

FIGS. 13-18 show the device 100 of the present invention in use. The device 100 can be easily carried by users and quickly positioned and controlled via the finger receiving portion 116. Further, the user's fingers (e.g., thumb) can engage the gripping portion 118 to facilitate manual manipulation of, or leverage on, the device 100 when opening a container.

Figure 13:
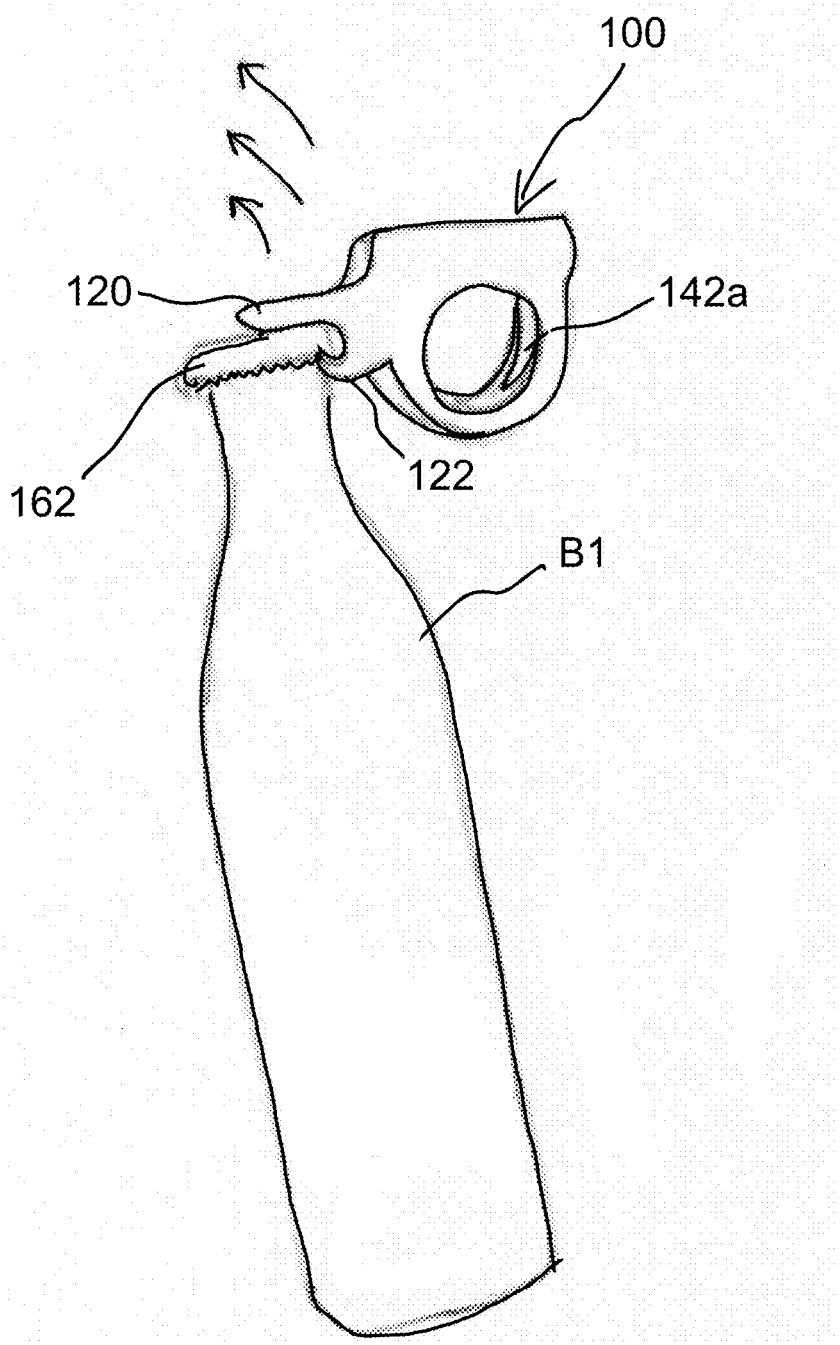
FIG. 13 shows use of a container opening device to open a bottle, in accordance with embodiments of the present invention.
Figure 15:
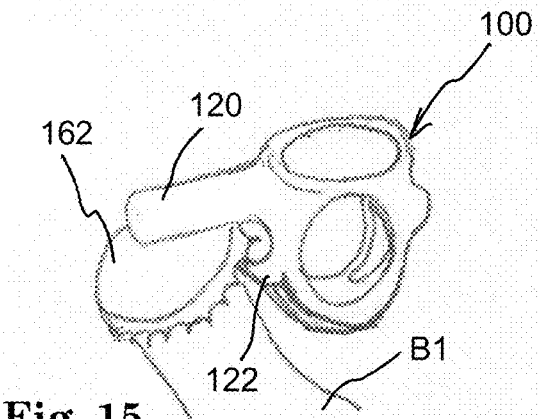
FIG. 15 shows a partial view of a container opening device used to open a bottle, in accordance with embodiments of the present invention.

The opening of a bottle B1 is depicted in FIGS. 13 and 15. The device 100 is engaged with the cap 162 such that the first member 120 is firmly pressed against the top of the cap 162 and the second member 122 is wedged to the bottom portion of the cap 162. Once properly engaged with the cap 162, the user pivots the device 100 to pry off or otherwise disengage the cap 162 from the top of the bottle B1.

Figure 14:
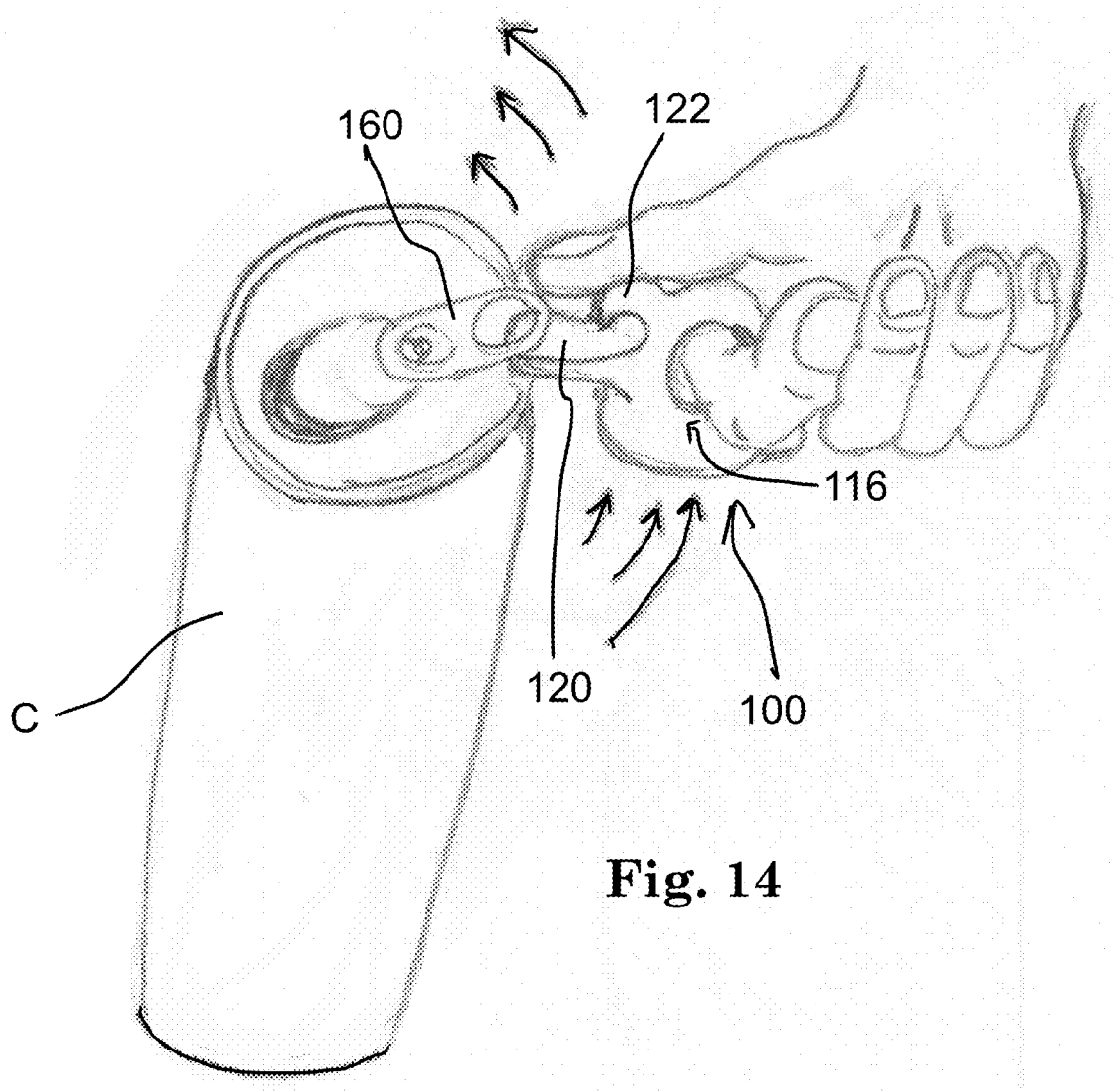
FIG. 14 shows use of a container opening device to open a can, in accordance with embodiments of the present invention.
Figure 16:
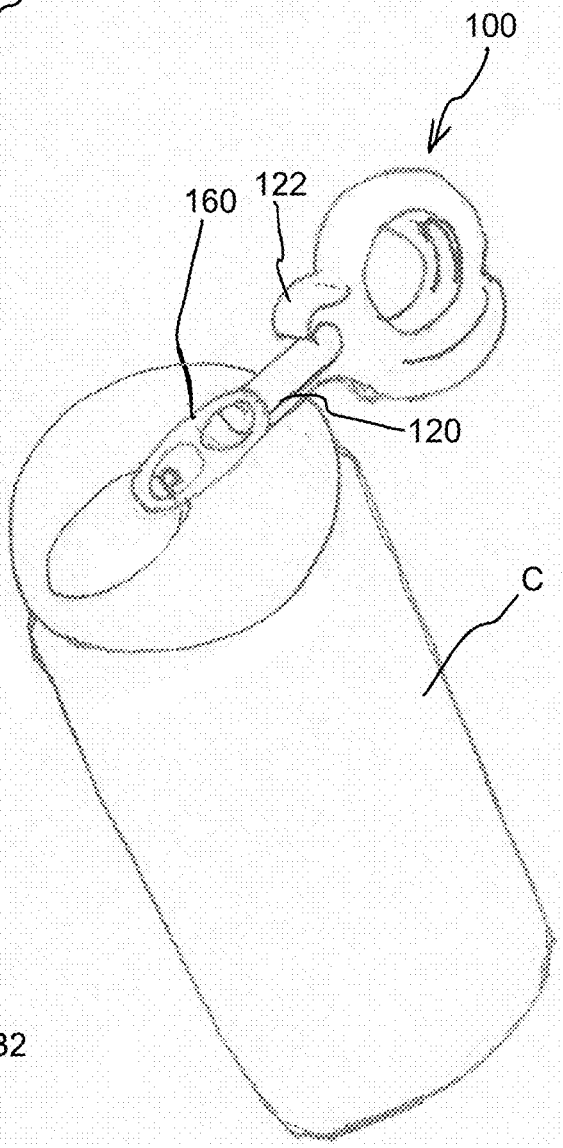
FIG. 16 shows use of a container opening device to open a can, in accordance with embodiments of the present invention.

FIGS. 14 and 16 show the opening of can C by prying the pull tab 160 upward. In such an operation, the device 100 is generally positioned upside down in the user's hand with the first member 120 inserted and engaged under the tab 160. The user then pivots the device to pry and lift the tab 160 to facilitate opening of the can C.

Figure 17:
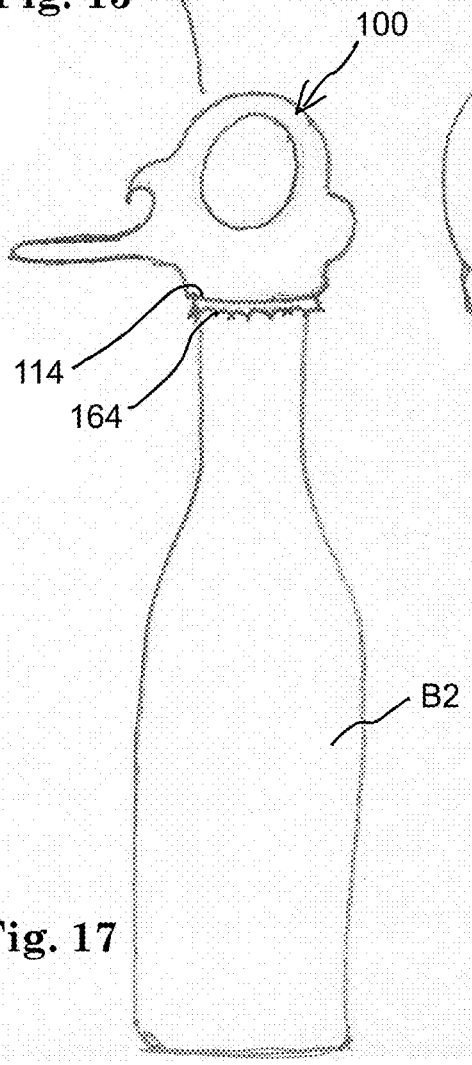
FIGS. 17-18 shows use of a container opening device to open a bottle top by twisting, turning, or prying, in accordance with embodiments of the present invention.
Figure 18:
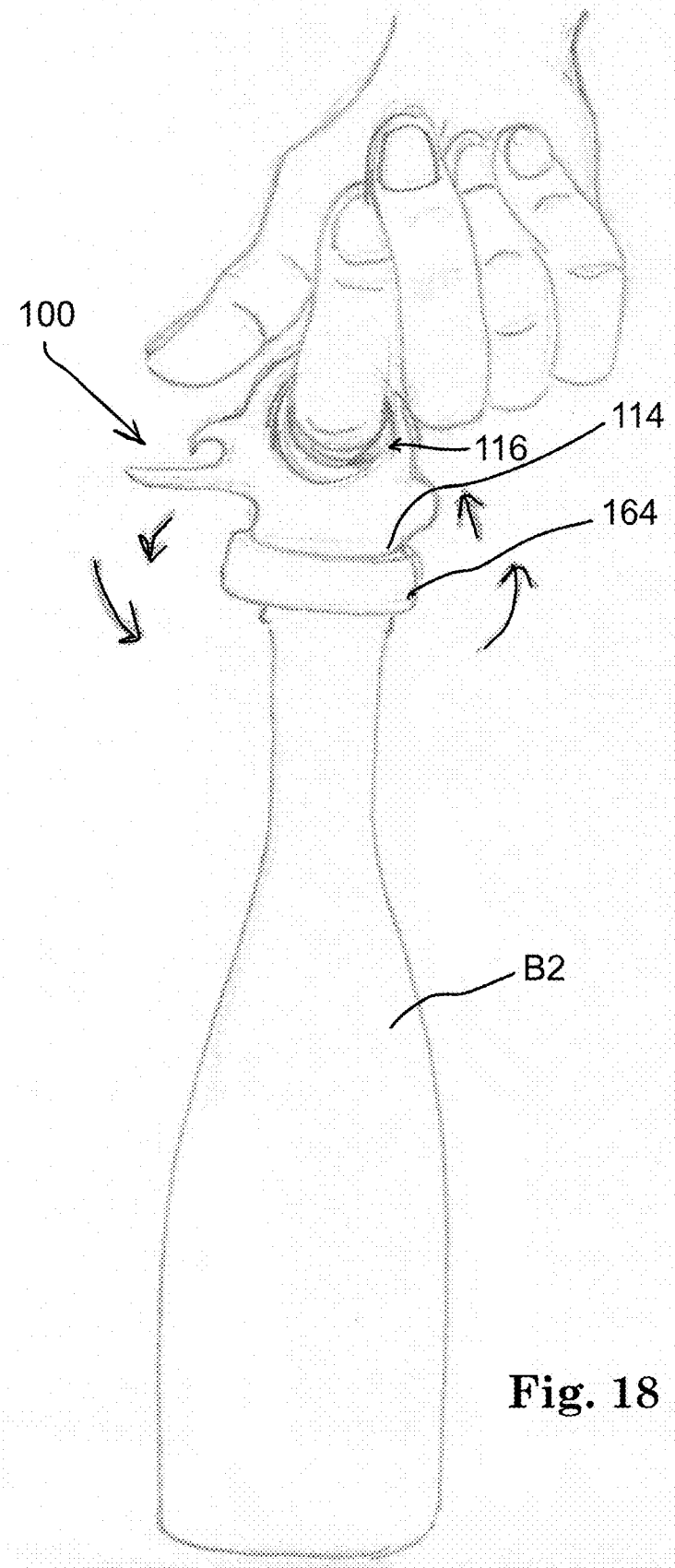

FIGS. 17-18 depict the opening of bottle B2. The device 100 is again positioned generally upside down in the user's hand with the twist-off portion 114 over the cap 164. As such, the inner teeth or protrusions 132 of the portion 114 are adapted to corresponding engage and selectively lock with the peripheral grooves/teeth of the cap 164. Once engaged, the user turns or twists the device 10 to release the cap 164 from the bottle B2.

Embodiments of the device 100 of the present invention can be manufactured and formed of various materials, including but not limited to plastics and metals, to advance and facilitate the design and structural details of the invention disclosed herein. In addition, various portions and structures can be constructed of a material different than other portions and structures of the device 100. Graphics, instructions, and other indicia can be provided to any portion of the device 100 to facilitate advertising, use, and the like.

The present invention may be embodied in other specific forms without departing from the spirit or essential attributes thereof, and it is, therefore, desired that the present embodiment be considered in all respects as illustrative and not restrictive. Similarly, the above-described methods and techniques for providing and using the present invention are illustrative processes and are not intended to limit the methods of manufacturing the present invention to those specifically defined herein. Further, features and aspects of the various embodiments described herein can be combined to form additional embodiments within the scope of the invention even if such combination is not specifically described herein.

What is claimed is:

1. A handheld container opening device, comprising:

a pry portion including a first extending member and a second extending member spaced apart from the first extending member and a channel formed between the first extending member and the second extending member;

a twist-off portion including a recess and a plurality of gripping teeth, the recess defining a bottom surface and the plurality of gripping teeth formed via a wall around the bottom surface extending in a first perpendicular direction outwardly from the bottom surface; and a finger receiving portion extending in a second perpendicular direction away from the bottom surface, the second perpendicular direction being opposite that of the first perpendicular direction, wherein the finger receiving portion defines a circular aperture oriented parallel to the bottom surface such that the handheld container opening device can be worn over a finger of a user while operating the twist-off portion, wherein the pry portion extends outwards beyond an outer perimeter of the wall in a direction parallel to the bottom surface, wherein the pry portion is arranged relative to the finger receiving portion such that the handheld container opening device can be worn over the finger of a user while operating the pry portion.

2. The device of claim 1, wherein the first extending member is a length longer than the second extending member.

3. The device of claim 1, wherein the first extending member further includes an engaging protrusion.

4. The device of claim 1, wherein the first extending member further includes a chamfered edge portion.

5. The device of claim 1, wherein the second extending member includes a generally arcuate edge portion.

6. The device of claim 1, wherein finger receiving portion includes one or more prongs.

7. The device of claim 6, wherein the one or more prongs have a spring-like characteristic.

8. The device of claim 1, further including a gripping portion.

9. The device of claim 8, wherein the gripping portion is an extending lip portion proximate the twist-off portion.

10. The device of claim 1, wherein the twist-off portion further includes an interior release tab disposed atop the bottom surface.

11. A handheld container opening device, comprising:

a pry portion including a first extending member and a second extending member spaced apart from the first extending member to define a generally arcuate interior engagement recess therebetween;

a twist-off portion including a recess and a plurality of peripheral gripping teeth, the recess defining a bottom surface and the plurality of gripping teeth formed via a wall extending in a first perpendicular direction outwardly from the bottom surface; and a ring portion including one or more prongs, the ring portion extending in a second perpendicular direction away from the bottom surface, the second perpendicular direction being opposite that of the first perpendicular direction, wherein the ring portion defines a circular aperture oriented parallel to the bottom surface such that the handheld container opening device can be worn over a finger of a user while operating the twist-off portion, wherein the one or more prongs define a selectively expandable boundary that securely engages the finger of the user when inserted through the ring portion.

12. The device of claim 11, wherein the first extending member is a length longer than the second extending member.

13. The device of claim 11, wherein the first extending member further includes an engaging protrusion.

14. The device of claim 11, wherein the second extending member includes a generally arcuate edge portion.

15. The device of claim 11, wherein the one or more prongs have a spring-like characteristic.

16. The device of claim 11, further including a gripping portion having an extending lip portion proximate the twist-off portion.

17. The device of claim 11, wherein the twist-off portion further includes an interior release tab.

18. A method of opening a container, comprising:

providing a handheld container opening device including a finger receiving portion, a pry portion and a twist-off portion, the pry portion having at least one extending member, and the twist-off portion having a recess and a plurality of gripping teeth;

inserting a finger by a user through the finger receiving portion, wherein the plurality of gripping teeth are disposed atop the finger of the user when the finger is inserted through the finger receiving portion, and wherein the pry portion extends outwardly from the finger receiving portion in a direction transverse to the twist-off portion when the finger is inserted through the finger receiving portion;

engaging the at least one extending member of the pry portion is with a can tab to facilitate opening of a can while the finger of the user is inserted through the finger receiving portion; and engaging the gripping teeth of the twist-off portion with peripheral grooves of a bottle cap to facilitate opening of a bottle cap while the finger of the user is inserted through the finger receiving portion.

19. The method of claim 18, wherein the at least one extending member is configured to engage under the can tab to facilitate opening via prying of the can tab.

20. The method of claim 18, wherein the gripping teeth of the twist-off portion facilitate opening of the bottle cap via a twisting motion.

* * * * *